US007093665B2

(12) United States Patent
Dass

(10) Patent No.: US 7,093,665 B2
(45) Date of Patent: Aug. 22, 2006

(54) METHOD OF ADAPTING A DOWNHOLE MULTI-PHASE TWIN SCREW PUMP FOR USE IN WELLS HAVING A HIGH GAS CONTENT AND A DOWNHOLE MULTI-PHASE TWIN SCREW PUMP

(76) Inventor: Pradeep Dass, 820 Reid Place, Edmonton, Alberta (CA) T6R 2M4

( * ) Notice: Subject to any disclaimer, the term of this patent is extended or adjusted under 35 U.S.C. 154(b) by 0 days.

(21) Appl. No.: 10/811,772

(22) Filed: Mar. 29, 2004

(65) Prior Publication Data

US 2005/0002812 A1 Jan. 6, 2005

Related U.S. Application Data

(63) Continuation of application No. PCT/CA02/01456, filed on Sep. 25, 2002.

(30) Foreign Application Priority Data

Sep. 28, 2001 (CA) ..... 2357887

(51) Int. Cl.
*E21B 43/00* (2006.01)

(52) U.S. Cl. ..... 166/380; 166/105.5; 417/408; 418/9

(58) Field of Classification Search ..... 166/380, 166/105, 105.5; 417/377, 406, 408; 418/9, 418/15

See application file for complete search history.

(56) References Cited

U.S. PATENT DOCUMENTS

| | | | | |
|---|---|---|---|---|
| 4,623,305 | A | 11/1986 | Segerstrom | |
| 5,871,340 | A | 2/1999 | Hatton | |
| 6,007,306 | A | 12/1999 | Vilagines | |
| 6,234,030 | B1 * | 5/2001 | Butler | 73/861.04 |
| 6,413,065 | B1 | 7/2002 | Dass | |

FOREIGN PATENT DOCUMENTS

| | | |
|---|---|---|
| CA | 2282231 | 9/2000 |
| EP | 0 216 406 A | 1/1987 |

* cited by examiner

*Primary Examiner*—William Neuder
(74) *Attorney, Agent, or Firm*—Christensen O'Connor Johnson Kindness PLLC

(57) ABSTRACT

A method of adapting a downhole multi-phase twin screw pump (10) for use in wells having a high gas content. A first step involves positioning a supplementary liquid channel (22,122) in a housing (12) of the pump in fluid communication with a pumping screw near an intake end (14) of the pump. A second step involves feeding supplementary liquid through the supplementary liquid channel to the pumping screw, thereby enhancing a liquid seal around the pumping screw.

14 Claims, 2 Drawing Sheets

METHOD OF ADAPTING A DOWNHOLE MULTI-PHASE TWIN SCREW PUMP FOR USE IN WELLS HAVING A HIGH GAS CONTENT AND A DOWNHOLE MULTI-PHASE TWIN SCREW PUMP

CROSS-REFERENCE TO RELATED APPLICATION

This application is a continuation of prior PCT Application No. PCT/CA02/01456, filed Sep. 25, 2002, designating the United States of America, which claimed priority from prior Canadian Application No. 2,357,887, filed in Canada on Sep. 28, 2001. Priority from the PCT Application No. PCT/CA02/01456 is claimed under 35 U.S.C. § 120.

FIELD OF THE INVENTION

The present invention relates to a method of adapting a downhole multi-phase twin screw pump for use in wells having a high gas content and a downhole multi-phase twin screw pump.

BACKGROUND OF THE INVENTION

Canadian Patent Application 2,282,231 and corresponding U.S. patent application Ser. No. 09/280,557 disclose a downhole multi-phase twin screw pump. These pumps are, typically, used in applications in which the medium being pumped includes oil, water, some solids and gas. In situations where there is a high gas content in the medium, the liquids present will be insufficient to effectively seal gaps in the screw. As a result there is a dramatic loss of pressure capability and efficiency. In addition, there is an increase in heat build up within the pump.

SUMMARY OF THE INVENTION

What is required is a method of adapting a downhole multi-phase twin screw pump for use in wells having a high gas content and a downhole multi-phase twin screw pump adapted in accordance with the teachings of the method to be capable of operating efficiently in wells having a high gas content.

According to one aspect of the present invention there is provided a method of adapting a downhole multi-phase twin screw pump for use in wells having a high gas content. A first step involves positioning a supplementary liquid channel in a housing of the pump in fluid communication with a pumping screw near an intake end of the pump. A second step involves feeding supplementary liquid through the supplementary liquid channel to the pumping screw, thereby enhancing a liquid seal around the pumping screw.

The high gas content in the fluid medium being moved by the downhole multi-phase twin screw pump deprives the twin screws of the liquid needed to form an effective liquid seal. The solution provided by the present invention is to supply supplemental liquid in sufficient quantity to make an effective liquid seal notwithstanding the high gas content.

According to another aspect of the present invention there is provided a downhole multi-phase twin screw pump which includes a housing having an intake end, an output end, and a fluid flow passage that extends between the intake end and the output end. Twin pumping screws are disposed in the fluid flow passage. A supplementary liquid channel extends through the housing in fluid communication with at least one of the twin pumping screws near the intake end of the housing. Means is provided for feeding supplementary liquid through the supplementary liquid channel to the at least one of the twin pumping screw, thereby enhancing a liquid seal around the twin pumping screws.

Once the teachings of the present invention are understood, it will be appreciated that there are several alternative ways of securing supplementary liquid for use in enhancing the liquid seal. Supplementary liquid can be obtained by positioning a liquid trap along a fluid flow passage extending through the housing of the pump to divert liquid passing through the pump. Supplementary liquid can, alternatively, be obtained by positioning a liquid trap adjacent a well head of the well to divert liquid passing from the well.

BRIEF DESCRIPTION OF THE DRAWINGS

These and other features of the invention will become more apparent from the following description in which reference is made to the appended drawings, the drawings are for the purpose of illustration only and are not intended to in any way limit the scope of the invention to the particular embodiment or embodiments shown, wherein.

DETAILED DESCRIPTION OF THE PREFERRED EMBODIMENT

Figure 1:
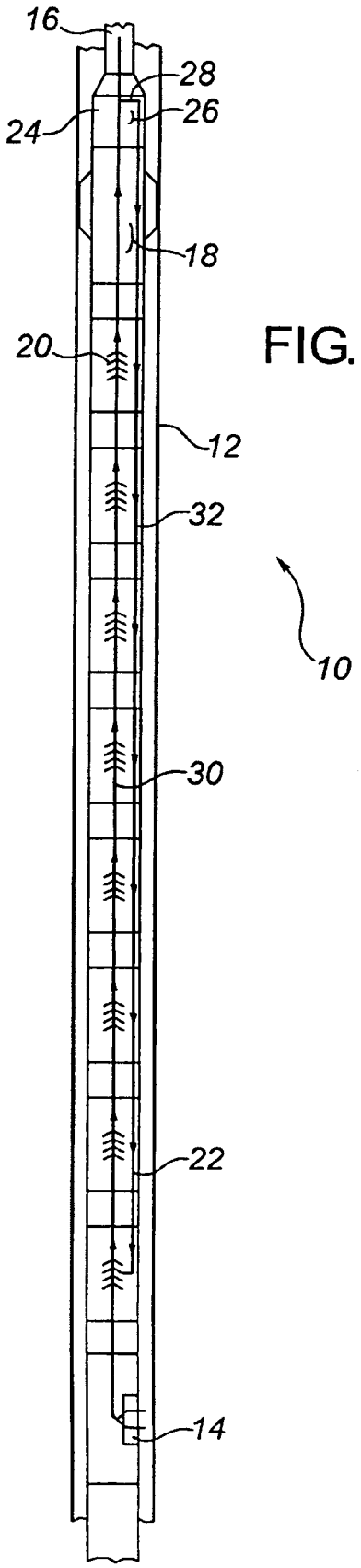
FIG. 1 is a side elevation view, in section, of a downhole multi-phase twin screw pump constructed in accordance with the teachings of the present method.

The preferred method of adapting a downhole multi-phase twin screw pump for use in wells having a high gas content will now be described with reference to two embodiments of downhole multi-phase twin screw pump. A first embodiment of downhole multi-phase twin screw pump, generally identified by reference numeral 10, will be described with reference to FIGS. 1 and 2. A second embodiment of downhole multi-phase twin screw pump, generally identified by reference numeral 100, will be described with reference to FIG. 3.

Figure 2:
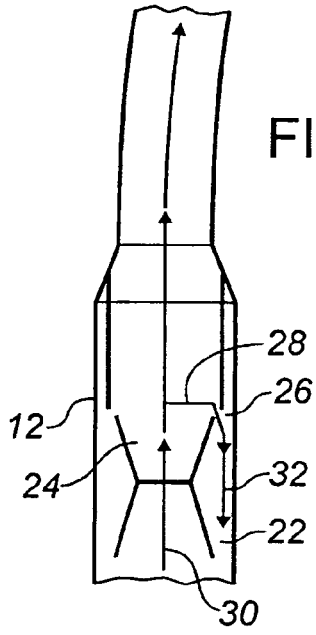
FIG. 2 is a detailed side elevation view, in section, of an eductor from the downhole multi-phase twin screw pump illustrated in FIG. 1.

Structure and Relationship of Parts:

Referring to FIG. 1, downhole multi-phase twin screw pump 10 includes a housing 12 having an intake end 14, an output end 16, and a fluid flow passage 18 that extends between intake end 14 and output end 16. Twin pumping screws 20 are disposed in fluid flow passage 18. A supplementary liquid channel 22 extends through housing 12 in fluid communication with twin pumping screws 20, preferably near intake end 14 of housing 12. A liquid trap 24 is provided that is in communication with fluid flow passage 18. Referring to FIGS. 1 and 2, liquid trap 24 uses an eductor 26 to capture a portion 28 of a liquid stream 30 being moved along fluid flow passage 18 by twin pumping screws 20 and feeds that portion 28 of liquid stream 30 as supplementary liquid 32 through supplementary liquid channel 22 to one of twin pumping screws 20, thereby enhancing a liquid seal around twin pumping screws 20.

Operation:

The use and operation of downhole multi-phase twin screw pump will now be described with reference to FIGS. 1 through 2. Referring to FIG. 1, to adapt downhole multi-phase twin screw pump 10 for use in wells having a high gas content, supplementary liquid channel 22 is positioned in housing 12 of downhole multi-phase twin screw pump 10 in fluid communication with twin pumping screws 20. Referring to FIGS. 1 and 2, as liquid stream 30 is moved along fluid flow passage 18 by twin pumping screws 20, liquid trap 24 uses eductor 26 to capture portion 28 of liquid stream 30 and directs that portion 28 of liquid stream 30 into supplementary liquid channel 22. Supplementary liquid 32 is then fed through supplementary liquid channel 22 to twin pumping screws 20, thereby enhancing a liquid seal around twin pumping screws 20.

Figure 3:
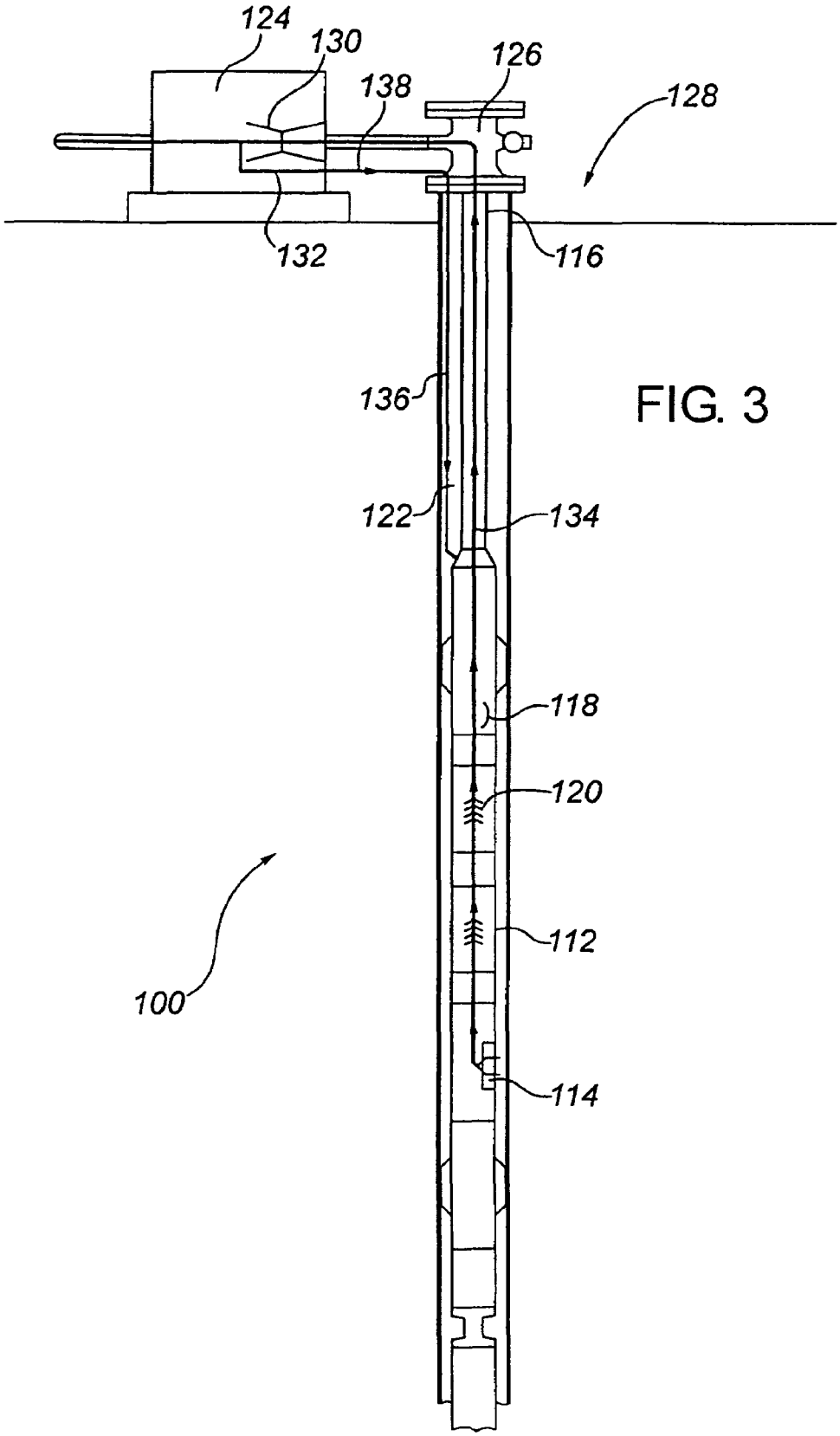
FIG. 3 is a side elevation view, in section, of a downhole multi-phase twin screw pump positioned in a well in accordance with the teachings of the present method.

Structure and Relationship of Parts:

Referring to FIG. 3, downhole multi-phase twin screw pump 100, in a combination which includes a housing 112 having an intake end 114, an output end 116, and a fluid flow passage 118 that extends between intake end 114 and output end 116. Twin pumping screws 120 are disposed in fluid flow passage 118. A supplementary liquid channel 122 extends through housing 112 in fluid communication with twin pumping screws 120 near intake end 114 of housing 112. A liquid trap 124 is positioned adjacent a well head 126 of well 128. This differs from first embodiment 10 in which liquid trap 24 was provided within housing 12. As with first embodiment 10, liquid trap 124 of second embodiment 100 also uses an eductor 130 to capture a portion 132 of a liquid stream 134 being moved through well 128 by twin pumping screws 120 and feeds that portion 132 of liquid stream 134 as supplementary liquid 136 through supplementary liquid channel 122 to twin pumping screws 120, thereby enhancing a liquid seal around twin pumping screws 120.

Operation:

The use and operation of second embodiment of downhole multi-phase twin screw pump will now be described with reference to FIG. 3. Second embodiment of downhole multi-phase twin screw pump 100 operates in the same fashion as first embodiment 10. To adapt downhole multi-phase twin screw pump 100 for use in wells 128 having a high gas content, supplementary liquid channel 122 is positioned in housing 112 of downhole multi-phase twin screw pump 100 in fluid communication with twin pumping screws 120. Although it is preferable to have supplementary liquid channel 122 positioned near intake end 114 of downhole multi-phase twin screw pump 100, practical considerations may result in supplementary liquid channel only extending partially down housing 112. Liquid stream 134 is moved along fluid flow passage 118 by twin pumping screws 120 and exits housing 112 and passes through wellhead 126 into liquid trap 124 that is adjacent to wellhead 126 of well 128. Liquid trap 124 then uses eductor 130 to capture portion 132 of liquid stream 134 and directs that portion 132 of liquid stream 134 through a flow line 138 into supplementary liquid channel 122 of housing 112. Supplementary liquid 136 is then fed through supplementary liquid channel 122 to twin pumping screws 120, thereby enhancing a liquid seal around twin pumping screws 120.

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

It will be apparent to one skilled in the art that modifications may be made to the illustrated embodiment without departing from the spirit and scope of the invention as hereinafter defined in the Claims.

The embodiments of the invention in which an exclusive property or privilege is claimed are defined as follows:

1. A method of adapting a downhole multi-phase twin screw pump for use in wells having a high gas content, comprising the steps of:

positioning a supplementary liquid channel in a housing of the pump in fluid communication with a pumping screw, the supplementary liquid channel extending through the housing from the output end to the intake end; and feeding supplementary liquid through the supplementary liquid channel to the pumping screw, thereby enhancing a liquid seal around the pumping screw.

2. The method as defined in claim 1, wherein the supplementary liquids are provided by a liquid trap which captures a portion of a liquid stream being moved by the pumping screw and recirculates that portion of the liquid stream as the supplementary liquid to the supplementary liquid channel.

3. The method as defined in claim 2, wherein the liquid trap is positioned along a fluid flow passage extending through the housing of the pump.

4. The method as defined in claim 3, wherein the liquid trap uses an eductor to capture the portion of the liquid stream.

5. The method as defined in claim 2, wherein the liquid trap is positioned adjacent a well head of the well.

6. The method as defined in claim 4, wherein the liquid trap uses an eductor to capture the portion of the liquid stream.

7. A method of adapting a downhole multi-phase twin screw pump for use in wells having a high gas content, comprising the steps of:

positioning a supplementary liquid channel in a housing of the pump in fluid communication with a pumping screw near an intake end of the pump, the supplementary liquid channel extending through the housing from the output end to the intake end;

providing a liquid trap which uses an eductor to capture a portion of a liquid stream being moved by the pumping screw; and feeding supplementary liquid from the liquid trap through the supplementary liquid channel to the pumping screw, thereby enhancing a liquid seal around the pumping screw.

8. The method as defined in claim 7, wherein the liquid trap is positioned along a fluid flow passage extending through the housing of the pump.

9. The method as defined in claim 7, wherein the liquid trap is positioned adjacent a well head of the well.

10. A downhole multi-phase twin screw pump, comprising:

a housing having an intake end, an output end, and a fluid flow passage that extends between the intake end and the output end;

twin pumping screws disposed in the fluid flow passage;

a supplementary liquid channel extending through the housing in fluid communication with at least one of the twin pumping screws near the intake end of the housing, the supplementary liquid channel extending through the housing from the output end to the intake end; and means for feeding supplementary liquid through the supplementary liquid channel to the at least one of the twin pumping screw, thereby enhancing a liquid seal around the twin pumping screws.

11. The pump as defined in claim 10, wherein the means for feeding supplementary liquid through the supplementary liquid channel is a liquid trap in communication with the fluid flow passage which captures a portion of a liquid stream being moved along the fluid flow passage by the twin pumping screws and recirculates that portion of the liquid stream as the supplementary liquid to the supplementary liquid channel.

12. The pump as defined in claim 10, wherein the liquid trap uses an eductor to capture the portion of the liquid stream.

13. A downhole multi-phase twin screw pump, comprising:

a housing having an intake end, an output end, and a fluid flow passage that extends between the intake end and the output end;

twin pumping screws disposed in the fluid flow passage;

a supplementary liquid channel extending through the housing from the output end to the intake end in fluid communication with at least one of the twin pumping screws near the intake end of the housing; and a liquid trap in communication with the fluid flow passage which uses an eductor to capture a portion of a liquid stream being moved along the fluid flow passage by the twin pumping screws and feeds that portion of the liquid stream as supplementary liquid through the supplementary liquid channel to the at least one of the twin pumping screw, thereby enhancing a liquid seal around the twin pumping screws.

14. A downhole multi-phase twin screw pump, comprising in combination:

a housing having an intake end, an output end, and a fluid flow passage that extends between the intake end and the output end;

twin pumping screws disposed in the fluid flow passage;

a supplementary liquid channel extending through the housing from the output end to the intake end in fluid communication with at least one of the twin pumping screws near the intake end of the housing; and a liquid trap positioned adjacent a well head of the well which uses an eductor to capture a portion of a liquid stream being moved through the well by the twin pumping screws and feeds that portion of the liquid stream as supplementary liquid through the supplementary liquid channel to the at least one of the twin pumping screw, thereby enhancing a liquid seal around the twin pumping screws.

* * * * *

UNITED STATES PATENT AND TRADEMARK OFFICE

CERTIFICATE OF CORRECTION

PATENT NO. : 7,093,665 B2
APPLICATION NO. : 10/811772
DATED : August 22, 2006
INVENTOR(S) : P. Dass It is certified that error appears in the above-identified patent and that said Letters Patent is hereby corrected as shown below:

| COLUMN | LINE | |
|---|---|---|
| 4 (Claim 6, | 27 line 1) | "claim 4," should read --claim 5,-- |

Signed and Sealed this

Twelfth Day of December, 2006

JON W. DUDAS
*Director of the United States Patent and Trademark Office*